US006802471B1

(12) United States Patent
Gambrell

(10) Patent No.: US 6,802,471 B1
(45) Date of Patent: Oct. 12, 2004

(54) CORD-ATTACHED WRAP-UP DEVICE

(76) Inventor: Michael G. Gambrell, 41 1/2 Village Dr., Ormond Beach, FL (US) 32174

( * ) Notice: Subject to any disclaimer, the term of this patent is extended or adjusted under 35 U.S.C. 154(b) by 0 days.

(21) Appl. No.: 10/435,108

(22) Filed: May 12, 2003

(51) Int. Cl.[7] ..... B65H 75/40

(52) U.S. Cl. ..... 242/402; 242/404.2; 242/405.1; 191/12 R

(58) Field of Search ..... 242/400.1, 402, 242/404.2, 405.1, 388.1; 191/12 R, 12.2 R; D8/356, 358, 395

(56) References Cited

U.S. PATENT DOCUMENTS

| | | | | | |
|---|---|---|---|---|---|
| 1,928,153 | A | * | 9/1933 | Hess | 242/405.1 |
| 2,204,939 | A | | 6/1940 | Lyons | |
| D136,783 | S | | 12/1943 | Le Veck | |
| 3,520,988 | A | | 7/1970 | Ballock | |
| D221,511 | S | | 8/1971 | Dufault | |
| 3,626,495 | A | | 12/1971 | Bastian | |
| 3,901,458 | A | | 8/1975 | Kuncz | |
| D281,574 | S | | 12/1985 | O'Hara | |
| 4,680,886 | A | | 7/1987 | Caselli | |
| 4,778,125 | A | * | 10/1988 | Hu | 242/405.2 |
| 4,779,816 | A | | 10/1988 | Varlet | |
| 4,998,700 | A | | 3/1991 | McKaig | |
| D378,053 | S | | 2/1997 | Forbis | |
| D389,731 | S | * | 1/1998 | Forbis | D8/395 |
| 2003/0052218 | A1 | * | 3/2003 | Knizner | 242/404.2 |

* cited by examiner

*Primary Examiner*—John M. Jillions
(74) *Attorney, Agent, or Firm*—Richard J. Johnson

(57) ABSTRACT

The invention relates to a multiple use cord-attached wrap-up device and optional accessory tool holder designed for use with hand-held electrical tools, electrical kitchen and bathroom appliances and cords of all types. The cord wrap-up device comprises a flat body member molded from resilient plastic or rubber having an integrally attached split cylindrical sleeve for attachment onto an electrical cord. The sleeve is designed to permit the wrap-up device to slide along a cord while remaining attached thereto. Arcuate recesses are provided at each end of the body member to receive and retain loops of an electrical cord. A number of cord trapping eyelets are located along one side of the body portion which are adapted to receive and grip the otherwise loose leading or trailing ends of a looped cord to prevent it from unwinding. One embodiment of the invention includes an integrally molded tool-mounting section having openings and grooves adapted to be used to attach a variety of accessory items, such as, Allen wrenches and drill chuck wrenches.

8 Claims, 2 Drawing Sheets

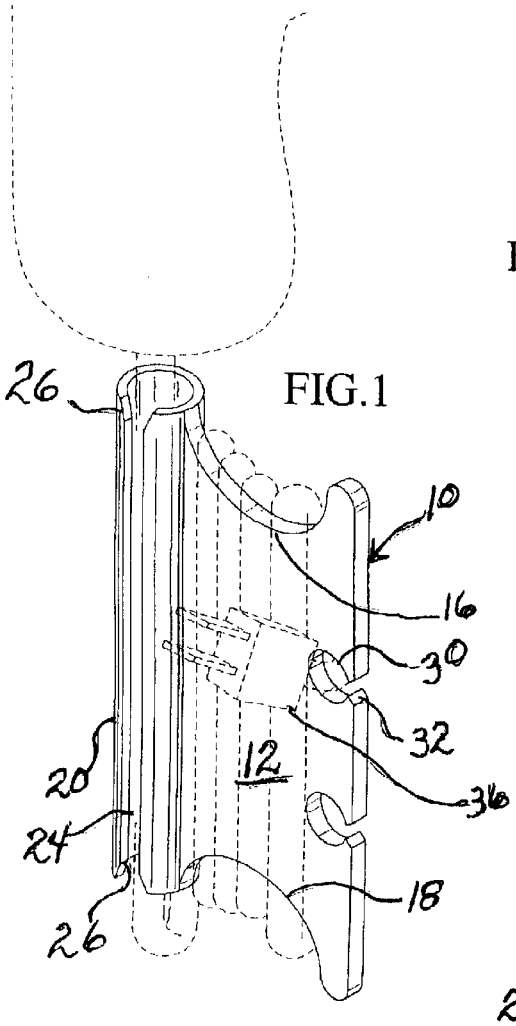
FIG.1
FIG.2
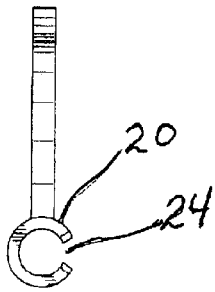
FIG.3
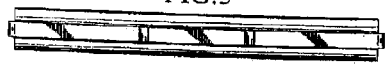
FIG.4
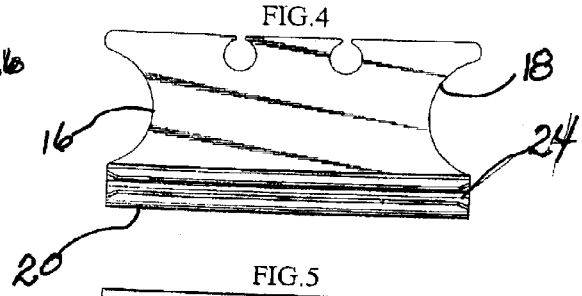
FIG.5
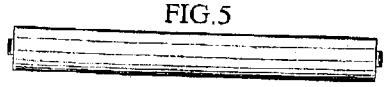
FIG.6
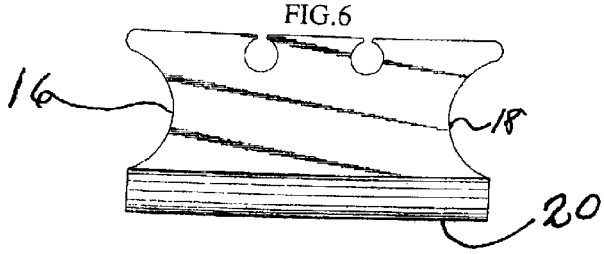

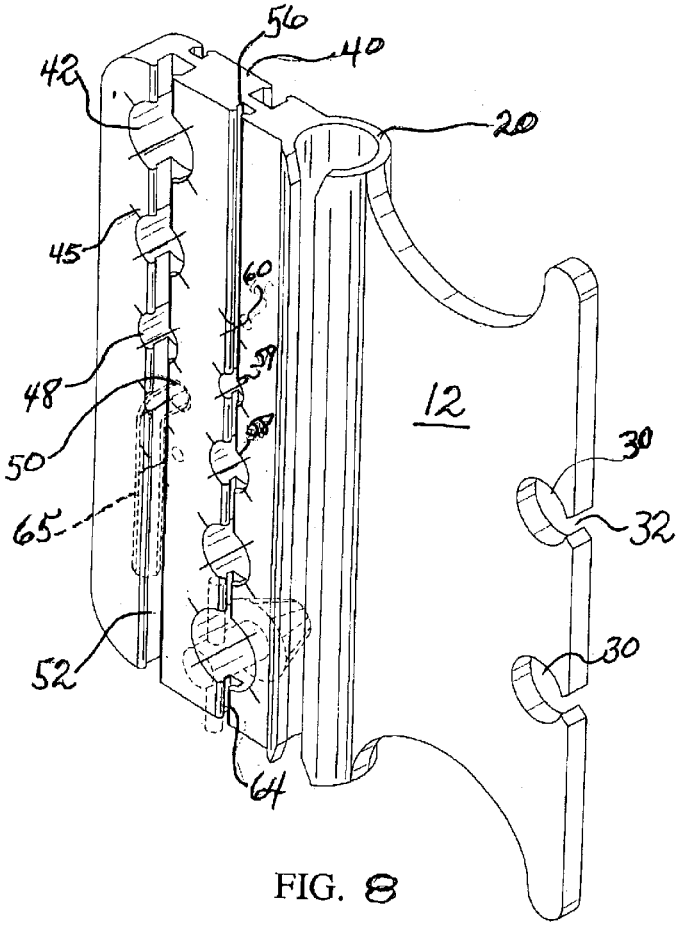
FIG. 8
FIG. 10
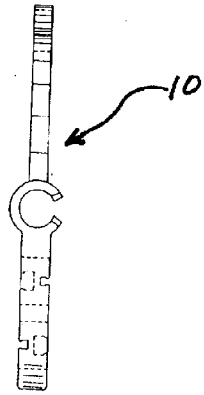
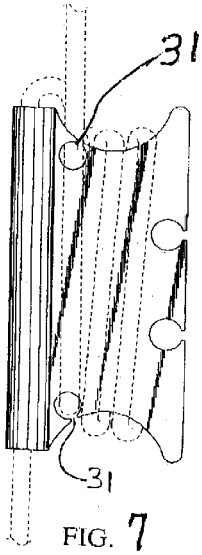
FIG. 7
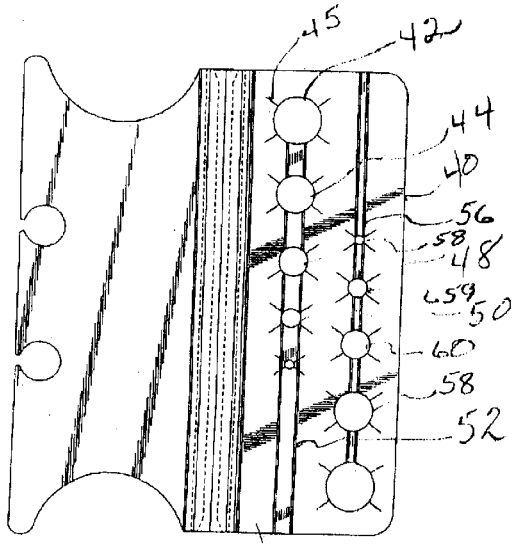
FIG. 9

CORD-ATTACHED WRAP-UP DEVICE

The invention relates to a cord-attached wrap-up device and optional accessory tool holder designed especially for use with hand-held electrical tools. However, the device can have application with a wide variety of other electrical appliances, such as, kitchen and bathroom appliances and electrical cords of all types including computer cords and speaker wires.

BACKGROUND OF THE INVENTION

Electrical cords and electrical wires used with all manner of equipment, such as, hand held drills, saws, routers, etc., frequently present problems during times of nonuse. If such are allowed to remain loose while stored with other electrical tools it is easy for them to become entangled and damaged. Cords connected between computers, printers, and speakers also easily become entangled.

Efforts have been made to provide reels of various types to wind up unused portions of electrical and other cords with some success but have failed in one or more ways to achieve a fully satisfactory solution. A significant drawback has been that the prior reels do not remain attached to the cord and easily become lost, or at least, are not readily available when needed and when the tool is to be placed in storage. Examples of such prior art devices known to the inventor are listed below.

The U.S. Pat. No. 3,626,495 to Bastian, Jr. is stated to be a Tangle Free Wire Holder. It does not, however, remain attached to the cord in use and thus can easily become lost.

The U.S. Pat. No. 3,901,458 to Kunez, Jr. is a Rope Caddy is designed for winding towing line and fishing lines. It does include a slotted sleeve along one side. However, the slot opening is generally in the plane of the base and is too wide to remain attached to a cord and clearly is not intended do so.

The U.S. Design Pat. No. 378,053 to Forbis is stated to be a Window Blind Storage Clip and has some obvious similarities to the invention herein disclosed. As in Kunez, Jr. the groove entrance is generally in the plane of the base and not at a right angle thereto. While it is intended to remain attached to the cord in use it appears that it could easily be pulled away therefrom. The winding portion also uses tapered notches, which would be unsuitable for most electric cords.

The U.S. Design Pat. Nos. D281,574 to O'Hara; D221,511 to Le Veck and DI36,783 to Dufault relate to cord reels but which are not designed to remain attached to a cord when not in use.

The U.S. Pat. No. 2,204,939 to Lyons is directed to a combined electrical cord reel and outlet plug. While it does remain attached to the cord in use the reel it is actually molded to the electrical plug and thus can be used only with the original cord. Also, it must be molded to the plug at the time of manufacture and can not be added later.

The U.S. Pat. No. 4,680,886 to Caselli, Sr. is directed to a fishing line winding device. It does have arcuate recessed portions in the ends and slots in the sides thereof but does not have a sleeve along a side thereof.

SUMMARY OF THE INVENTION

The cord wrap-up device disclosed herein comprises a flat body member molded from resilient plastic or rubber having an integrally attached split cylindrical sleeve for attachment onto an electrical cord and for slideable movement thereon.

The wrap-up body member includes arcuate recesses at each end thereof adapted to receive and retain one or more loops of an electrical cord. Located around the body periphery and adjacent the edges thereof are a number of cord trapping eyelets each having an inlet groove adapted to receive and secure an otherwise loose leading or trailing end of a looped cord to prevent it from unwinding. The sleeve is designed to have an internal diameter slightly larger than the intended tool power cord to permit the wrap-up device to slide along the length of the cord while remaining attached thereto. One embodiment of the invention includes an integrally molded tool-mounting section having openings and grooves adapted to be used to attach a variety of accessory items, such as Allen wrenches and drill chuck wrenches so that they can be readily available for use with the tool.

It is a primary object of the invention to provide a cord wrap-up device for winding excess or unused power cord for an electrical tool or kitchen or bathroom appliance and a wide variety of other cords thereon and which is slideable along the length of the cord while remaining attached thereto if desired.

It is a further object to provide a cord wrap-up device that includes an accessory tool holding portion for items such as Allen wrenches and drill chuck wrenches so that they can be readily available when needed for use with the tool.

It is a further object to provide a cord wrap-up device that may be used for winding excess cord from a wide variety of electrical and non-electrical devices including computer cords, speakers and kitchen appliances and which can be manufactured at relatively low cost.

BRIEF DESCRIPTION OF THE DRAWINGS

FIG. 1 is a vertical perspective of the cord wrap-up device

FIG. 2 is an end view thereof.

FIG. 3 is a top view of the cord wrap-up device

FIG. 4 is a front view

FIG. 5 is a bottom view

FIG. 6 rear view in vertical elevation

FIG. 7 is a slightly modified embodiment.

FIG. 8 is an embodiment wherein the wrap-up device includes an accessory tool holding section.

FIG. 9 is a rear view of the embodiment of FIGS. 8–10.

FIG. 10 is an end view of the embodiment of FIGS. 8–10

DETAILED DESCRIPTION OF THE INVENTION

In the embodiment disclosed in FIGS. 1–6 the cord attached wrap-up device 10 comprises a substantially flat body portion 12 molded from relatively soft plastic or rubber. Opposite end portions of the body portion 12 are formed with arcuate recesses 16 and 18 which provide cord winding and storage portions.

A split sleeve 20 is integrally formed along one edge of the body portion 12. A cord entrance slot 24 having beveled end portions 26 is formed along one side of the sleeve. An important feature of the invention is that the slot 24 is formed along the side of the sleeve such that it does not open in the general plane of the body member but is angularly offset therefrom to reduce the likely hood of the cord being inadvertently pulled out of the slot and becoming lost. The preferred angle at present locates the slot 24 generally perpendicular to the plane of the body portion 12. However, it appears that the degree of angular offset of the slot could vary and still accomplish the intended purpose. It is possible that by locating the slot closer to the juncture with the body portion 12 it might make it even more difficult for the cord to be accidentally dislodged from the sleeve. The inner diameter of the sleeve 20 is designed so as to be slightly larger than that of a cord with which the wrap-up device is intended to be used so that it may be slid along the cord to a desired out of the way location or used in one of a number of ways as explained.

Eyelets 30 having tapered lead-in notch portions 32 are formed along the long edge of the body 12 at appropriate locations. As shown, for example, in FIG. 1 eyelets 30 are located along the side of the body portion 12 opposite the sleeve 20. In FIG. 7, additional eyelets 31 are located offset to one side of the recessed portions 16, 18. Eyelets 30 and 31 are adapted to entrap leading or trailing portions of a plurality of loops of cord wound on the device to hold it secure either in a partially wrapped condition, as illustrated in FIG. 7, or in a fully wrapped condition, as illustrated in FIG. 1, where the tool has been prepared for storage.

As illustrated in FIG. 7, eyelets 31 may be used when it is desired merely to shorten the length of a cord to prevent any excess from becoming a problem. A length of cord at a mid-portion thereof or at any other location along its length can be wound around the device and secured using the eyelets 31. Some of the eyelets such as those indicated at 31 in FIG. 7 can be of smaller diameter than those indicated at 30 to enable the wrap-up device to be used with cords of different sizes.

A further use of the wrap-up device, which is not illustrated, is as a plug lock to prevent two cords, which are spliced together from being pulled apart. Since the plug end of one cord is secured within sleeve 20 the connected end of the second cord may be simply partially looped and secured in one of the eyelets 30 to effectively prevent the cord connection from being pulled apart.

In the modification illustrated in FIGS. 8–10, the cord wrap-up body portion and sleeve 20 are the same as in FIGS. 1–6 except that an accessory tool support section 40 is integrally molded to the opposite side of sleeve 20. Tool support section 40 includes a number of grooves and openings of different sizes for holding a variety of sizes of accessory tools intended for use with the tool. Generally circular openings 42 and 44 with radially disposed slits 45, for increased flexibility around the openings, are provided for inserting and securing the enlarged end of a drill chuck tool as shown in phantom lines in FIG. 8. As illustrated, the chuck handle can be snapped into the groove 64 if desired. Additional openings such as 48, 50 with intersecting grooves 52 are designed for securing a variety of sizes of Allen wrenches 65 which are sometimes needed to make adjustments on certain tools. Groove 56 which intersects a further set of openings 58, 59, 60 is designed for retaining Allen wrenches which are smaller in size than those which will fit in groove 52. The grooves 52 and 56 include lips 64 along each side thereof, which serve to grip or entrap Allen, or other wrenches, as shown in phantom in FIG.8.

To use the cord wrap-up device a power or other cord is held over and adjacent the slot 24 of the sleeve 20 which is then tilted with respect to the cord to enable the beveled edges 26 at the ends of the slot to be cammed apart. The cord is then pressed until it has been forced entirely and substantially locked within the sleeve. The device can then be slid along the cord to either end thereof so that it may be wound thereon if the tool is to be placed in storage. Alternatively, the device may be allowed merely to remain on the cord out of the way while the tool is being used and until it is needed to wrap-up the cord. The location along the cord selected will depend on the particular use intended at the time. In either case any excess cord can be retained in a tangle free manner and the device will remain on the cord where it can be readily located and used in a variety of ways as needed.

Variations and modifications of the present invention will be apparent to those skilled in the art within the scope of the present claims.

I claim:

1. A cord wrap-up device formed of resilient material comprising: a substantially flat body portion of generally rectangular configuration in outline, said body portion including longitudinally extending sides and laterally extending end portions, said end portions including recessed areas for winding a length of cord thereon, one of said longitudinally extending sides including at least one notched eyelet of a size to receive and entrap a section of cord therein, the other of said longitudinally extending sides having a sleeve integral therewith, said sleeve having a generally cylindrically shaped inner surface and being sized such that it may be disposed over a length of cord, said sleeve having an entrance slot extending the length thereof at a location angularly offset from the plane of said flat body portion whereby the slot may be resiliently expanded and forced over a cord with the sleeve enclosing and movable along the cord to a desired location, whereby a length of cord may be wrapped around the recessed areas of the body portion while a section thereof remains secured within the sleeve and with the leading or trailing portion of at least one wrapped cord loop gripped and secured within an eyelet.

2. The cord wrap-up device of claim 1, wherein eyelets are also formed in the recessed areas.

3. The cord wrap-up device of claim 1, wherein the ends of the slot include lead-in beveled surfaces for guiding a cord therein.

4. The cord wrap-up device of claim 1, wherein an accessory tool support is secured to the sleeve and includes means for retaining tools.

5. The cord wrap-up device of claim 4, wherein the means for retaining tools comprises openings adapted to retain a drill chuck.

6. The cord wrap-up device of claim 4, wherein the means for retaining tools comprises grooves and openings adapted to retain Allen wrenches therein.

7. The cord wrap-up device of claim 6 further including lips disposed along the edges of the grooves.

8. A cord wrap-up device formed of resilient material comprising: a substantially flat body portion of generally rectangular configuration in outline, said body portion including longitudinally extending sides and laterally extending end portions, said end portions including recessed areas for winding a length of cord thereon, one of said longitudinally extending sides including at least one notched eyelet of a size to receive and entrap a section of cord therein, the other of said longitudinally extending sides having a sleeve integral therewith, said sleeve having a generally cylindrically shaped inner surface and being sized such that it may be disposed over a length of cord, said sleeve having an entrance slot extending the length thereof at a location angularly offset from the plane of said flat body portion whereby the slot may be resiliently expanded and forced over a cord with the sleeve enclosing and movable along the cord to a desired location, whereby a length of cord may be wrapped around the recessed areas of the body portion while a section thereof remains secured within the sleeve and with the leading or trailing portion of at least one wrapped cord loop gripped and secured within an eyelet, and an accessory tool support secured to the sleeve and having a plurality of openings for securing accessory tools thereto.

* * * * *